US007111621B2

(12) United States Patent
Lin

(10) Patent No.: US 7,111,621 B2
(45) Date of Patent: Sep. 26, 2006

(54) PAINTBALL MARKER PISTOL WITH SLIDE ACTION AUTOMATIC RE-COCKING

(76) Inventor: Ting-huei Lin, 7F, No. 12, Lane 106, SEC 3 Minchuan Est Road, Taipei (TW) 105

( * ) Notice: Subject to any disclaimer, the term of this patent is extended or adjusted under 35 U.S.C. 154(b) by 273 days.

(21) Appl. No.: 10/897,267

(22) Filed: Jul. 22, 2004

(65) Prior Publication Data

US 2006/0027224 A1 Feb. 9, 2006

(51) Int. Cl.
*F41B 11/00* (2006.01)

(52) U.S. Cl. ..... 124/74

(58) Field of Classification Search ..... 124/74
See application file for complete search history.

(56) References Cited

U.S. PATENT DOCUMENTS

| | | | | |
|---|---|---|---|---|
| 5,613,483 | A | 3/1997 | Lukas et al. | |
| 6,418,920 | B1 | 7/2002 | Marr | |
| 6,494,194 | B1 * | 12/2002 | Shipachev et al. | 124/73 |
| 6,601,780 | B1 | 8/2003 | Sheng | |
| 6,637,420 | B1 | 10/2003 | Moritz | |
| 6,644,295 | B1 | 11/2003 | Jones | |
| 6,694,658 | B1 * | 2/2004 | Marsac | 42/54 |
| 2002/0046748 | A1 | 4/2002 | Hernandez | |
| 2006/0027225 | A1 * | 2/2006 | Homsky | 124/72 |

* cited by examiner

*Primary Examiner*—Troy Chambers
(74) *Attorney, Agent, or Firm*—Stetina Brunda Garred & Brucker

(57) ABSTRACT

The present invention comprises a novel hammer and biasing system in a paintball pistol to achieve automatic re-cocking with closed bolt results in a marker pistol configuration typically associated with open bolt systems. The trigger releases a compressions hammer that nests in a hammer sleeve, but an aperture in the hammer sleeve permits a protrusion on the compression hammer to strike a poppet valve which releases a burst of gas. The gas pressure forced into the barrel causes the paint ball to be expelled from the barrel, and forces the hammer and bolt assembly aft due to increased pressure in the lower bore. The pressure against the front wall of a hammer sleeve pushes the hammer sleeve aft, along with the compression hammer. Also, because the bolt is interconnected to the hammer sleeve it is forced back in the upper barrel as well. When forced back, the bolt allows the breach to open and a paintball to drop into the chamber. Also, the sear catches the compression hammer in the cocked position. The interconnected combination of the hammer sleeve, bolt and slide cover causes the slide cover to move back as well. Springs interconnected between the slide cover and the housing are stretched when the slide cover moves back, but biases the slide cover to return to its forward position. Because the slide cover is interconnected to the bolt and hammer sleeve, the return of the slide cover forward by the springs, also resets the bolt and hammer sleeve to their forward ready to fire position.

15 Claims, 8 Drawing Sheets

PAINTBALL MARKER PISTOL WITH SLIDE ACTION AUTOMATIC RE-COCKING

CROSS-REFERENCE TO RELATED APPLICATIONS

Not Applicable

STATEMENT RE: FEDERALLY SPONSORED RESEARCH/DEVELOPMENT

Not Applicable

BACKGROUND OF THE INVENTION

The present invention relates generally to a paintball marker pistol having an automatic re-cocking system. More particularly, the present invention comprises a novel hammer and biasing system in a paintball pistol to achieve automatic re-cocking with closed bolt results in a marker pistol configuration typically associated with open bolt systems. The invention provides a user with slide action recoil and re-cocking that is efficient, effective and provides a user with the simulated feel of the action of a conventional firearm pistol.

The recreational sport of "Paintball" is currently popular and is growing in popularity. In the sport, players simulate armed conflict using paintball marker guns that have the look and feel of conventional firearms. The marker guns propel encapsulated paint pellets, generally referred to as paintballs, which rupture upon impact. In the sport, an opponent or player that is hit with a paintball will be marked, and thus is considered ineligible from further participation in the game. A variety of types of games, scenarios and team play may be implemented, but each player requires the use of a paintball marker gun. Players thus desire paintball marker guns that are efficient, accurate and easy to use to aid their chances in succeeding in the paintball sport.

Several types of paintball guns are available on the market and vary widely in price and complexity. Conventional designs include, but are not limited to, open bolt and closed bolt. A discussion of the differences between open bolt design and closed bolt design can be found in U.S. Pat. No. 6,637,420 entitled "Closed Bolt Assembly for a Paintball Marker Gun," issued Oct. 28, 2003. The substance of which is incorporated herein by reference.

Open bolt paintball markers are typically less expensive due to their simplicity in design and lower cost of manufacture. In an open bolt design, the gun housing includes an upper barrel chamber and a lower gas pressure chamber. The gun includes a bolt and hammer assembly, wherein, the bolt is located in the barrel while an interconnected hammer is located in the lower pressure chamber. In the cocked position, a sear, mechanically connected to a trigger, holds the hammer and bolt assembly in a cocked position. When the assembly is cocked, a paintball is fed into the barrel and into firing position next to the bolt. Upon actuation of the trigger, the sear clears the lower chamber to a position that allows the hammer and interconnected bolt to be pushed forward by an internal spring. The hammer impacts a poppet valve which forces compressed gas into the barrel. The force of the bolt striking the paintball, along with the pressurized gas, propels the paintball out of the gun barrel. In addition, the release of gas pressure in the lower chamber causes the hammer and interconnected bolt assembly to be pushed backwards, to be caught by the sear and thus re-cocked.

Certain disadvantages have been associated with the open bolt design. The action of the bolt and hammer moving together many times catches a paintball that has not fully loaded into the barrel, and can cause deformation or breakage of the paintball in the barrel. A paintball breaking within the barrel may compromise further use of the gun before it is cleaned. The internal paint can cause inaccurate firing or a jammed gun, thus rendering it unusable for a period of time. Additionally, deformation to the paintball can cause inaccurate trajectories.

Closed bolt design guns address some deficiencies of the open bolt design guns, but are typically more expensive and are more complex in design. The primary difference between the closed bolt design and the open bolt design is that the hammer and bolt are not interconnected, thus only the compressed air forces the paintball from the barrel. Further, the closed bolt configuration allows the paintball to be in place for firing prior to the hammer being initiated. The pre-placement of the paintball minimizes the deformation or breakage of the paintball. In this configuration, the gas in the lower chamber re-cocks the hammer, however, because the bolt is not interconnected to the hammer a secondary system is required to reset the bolt. Resetting the bolt automatically is necessary to have pre-placement of the paintball. Additional systems include, but are not limited to, a secondary lumen or gas source that operates the bolt. The secondary system adds complexity, weight and expense to the closed bolt design. Previous devices have attempted to convert existing open bolt designs to create closed bolt action. In such designs, however, the bolts are separated from the hammers, are complex and secondary system are required to reset the bolt.

Thus, there is a great need in the art for the manufacture of a paintball marker gun that is based upon an inexpensive open bolt design, yet provides closed bolt accuracy and efficiency when firing the marker. In addition, there is a great need in the art for a simplified secondary system that will reset the bolt in closed bolt designs when firing. Finally, it would be advantageous and desirable to create a paintball pistol that simulates the slide action re-coil and re-cocking of conventional firearms.

BRIEF SUMMARY OF THE INVENTION

The present invention comprises a novel hammer and biasing system in a paintball pistol to achieve automatic re-cocking with closed bolt results in a marker pistol configuration typically associated with open bolt design. The invention provides a user with slide action recoil and re-cocking that is efficient, effective and simulates the feel of the action of conventional firearm pistols.

The paintball marker gun of the present invention comprises three standard gun components, a handle assembly, a gun body and a paintball clip. The gun body sits atop the handle assembly, and the clip is attached to atop the gun body to feed paintballs into the gun body. The gun body includes a chamber housing having upper and lower parallel bores. The upper bore is an elongated barrel having a top breach for receiving paintballs, and a forward aperture for ejecting and propelling paintballs. The lower bore includes a gas flow path leading to the upper bore or barrel.

The gun body further includes a slide cover which partially covers and engages the chamber housing such that the slide cover can move between a forward ready to fire position and an aft recoiled position. Two springs located on both sides of the gun body interconnect the chamber housing and the slide cover to provide a biasing force upon said slide cover to bias the slide cover to forward position.

A poppet valve is positioned within the lower bore of the chamber housing in gas flow communication with a carbon dioxide canister. A second canister can also be interconnected to the valve. A compression switch on the poppet valve faces a hammer assembly in the lower bore. Upon the hammer striking the compression switch of the poppet valve, the valve releases high pressure gas into the upper and lower bores of the chamber housing.

A hammer and bolt assembly is positioned within the chamber housing. The hammer and bolt assembly includes a cylindrical bolt positioned in the barrel of said chamber housing. The bolt is interconnected to the slide cover at the aft end of the slide cover. The bolt can move between a forward ready to fire position, and an aft just fired position that allows a paintball to drop into the barrel. In the ready to fire position the bolt blocks the breach so the paintball cannot enter the barrel. Because the bolt is interconnected to the slide cover, it moves in tandem with the slide cover.

The hammer and bolt assembly also comprises a hammer assembly positioned in the lower bore of the chamber housing. The hammer assembly is comprised of three major components, namely, a compression hammer, a spring, and a hammer sleeve.

The compression hammer is movable between forward and aft positions, wherein in said forward position, said compression hammer engages the compression switch of the poppet valve, and wherein said aft position, said hammer assembly is cocked. The compression hammer is not interconnected to the bolt which is similar to a conventional closed bolt system and thus moves independent of the bolt.

The spring is placed over a rod connected to the compression hammer. The rod can move through an aperture in a cylindrical back stop when in the cocked position. The spring is compressed when the compression hammer is forced to the cocked position. A sear provides a means of catching the compression hammer and holding it in place in the cocked position. The sear is interconnected to a trigger located in the handle assembly and is actuated to release the compression hammer. The forward face of the compression hammer includes a protrusion used to strike the switch of the poppet valve.

A generally cylindrical hammer sleeve includes forward aperture and aft aperture. The hammer sleeve is movable between forward and aft positions and is interconnected to the bolt in the upper bore. The hammer sleeve has an internal bore sized to receive the compression hammer through an aft aperture. The front of the hammer sleeve is partially enclosed by a front wall to stop the compression hammer when it is forced forward by the spring. The front wall of the hammer sleeve includes an aperture sized to permit passage of the protrusion of the compression hammer in its forward position to engage the compression switch of the poppet valve.

In operation, upon compression of the trigger, movement of the sear, and release of the compression hammer, the hammer assembly spring forces the compression hammer forward, through the aft aperture of the hammer sleeve, into the bore of the sleeve, allowing the protrusion of the compressing hammer to extend through the front wall aperture of said sleeve and to strike the compression switch of the poppet valve. As a result, the poppet valve releases a burst of gas pressure into the lower bore and the barrel of the chamber housing through an opening between the two bores. The gas pressure forced into the upper bore causes the paintball to be expelled from the barrel. The hammer and bolt assembly are forced backwards in the lower bore by the increase in pressure. The pressure against the front wall of the hammer sleeve pushes the hammer sleeve aft, along with the compression hammer now nested in the sleeve bore. The bolt, interconnected to the hammer sleeve, is forced back in the upper barrel as well. When forced back, the bolt allows the breach to open and a paintball to drop into the chamber. The sear catches the compression hammer in the cocked position and the interconnected combination of the hammer sleeve; bolt and slide cover causes the slide cover to move back as well, simulating the recoil sliding action of a conventional firearm. The springs interconnecting the slide cover with the housing are stretched when the slide cover moves back, but biases the slide cover to return to its forward position. Because the slide cover is interconnected to the bolt and hammer sleeve, the return of the slide cover forward by the springs, also resets the bolt and hammer sleeve to their forward ready to fire position. The forward position of the bolt closes the breach of the barrel to exclude other paintballs form dropping into the barrel.

BRIEF DESCRIPTION OF THE DRAWINGS

Features of the present invention will become more apparent upon reference to the drawings wherein.

DETAILED DESCRIPTION OF THE INVENTION

The detailed description as set forth below in connection with the appended drawings is intended as a description of the presently preferred embodiments of the present invention, and does not represent the only embodiment of the present invention. It is understood that various modifications to the invention may be comprised by different embodiments and are also encompassed within the spirit and scope of the present invention.

Figure 1:
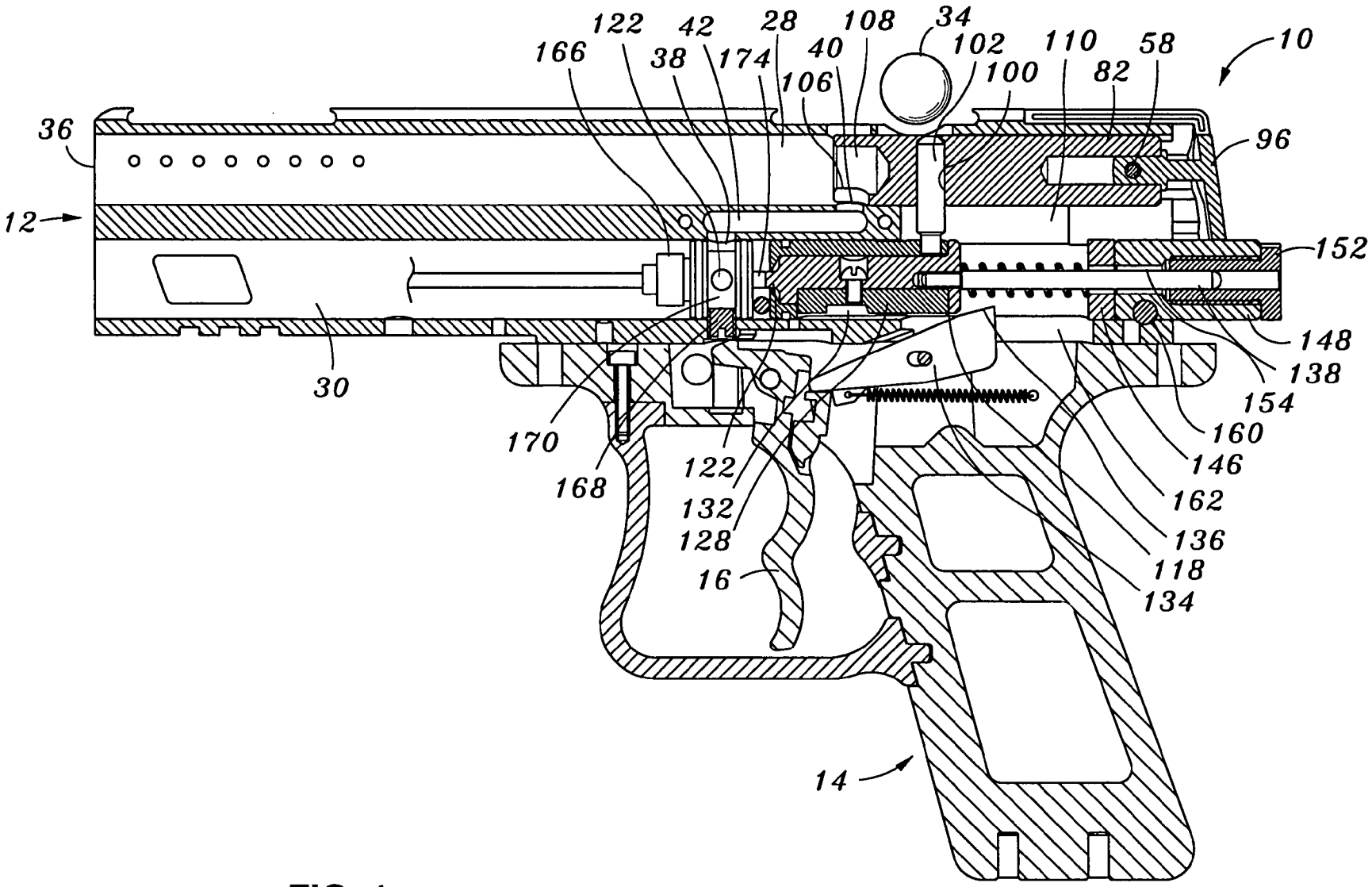
FIG. 1 is a cross-sectional side view of the paintball marker pistol of the present invention.

Referring particularly to FIG. 1 there shows a cross-sectional side view of the paintball marker pistol 10 of the present invention. As with most paintball marker pistols, the marker 10 includes three main components, the gun body 12, the handle assembly 14, and a paintball clip (not shown).

The handle assembly 14 includes a trigger 16 for firing the pistol marker 10 and such handle assembly 14 is connected to the bottom of the gun body 12. A paintball clip (not shown) rests on top of the gun body 12 to drop paintballs into the gun body 12 prior to firing Referring particularly to FIG. 2, there is shown an exploded view of many of the components of the gun body 12. Referring particularly to both FIGS. 1 and 2, the gun body 12 includes chamber housing 18, bolt and hammer assembly 20 and slide cover assembly 26.

The chamber housing 18 includes two parallel bores, the upper bore being the pistol barrel 28, and the lower bore 30. The barrel 28 is an elongate bore with a breach 32 to accept paintballs 34 in the barrel 28. The barrel 28 includes an opening 36 at the front end of the barrel to expel the paintball when the marker 10 is fired. Lower opening 38 and upper opening 40 lead to an open channel 42 such that the lower bore 30 and the barrel 28 are in gas flow communication. A recess 44 is provided in the side wall 46 of the chamber housing 18. A recess cover 48 covers the recess 44 in the open channel 42 to complete an enclosed pathway from the lower bore 30 through opening 38 to the open channel 42, and opening 40 into the opening barrel 28. The cover 48 provides an effective seal to provide the enclosed pathway from the lower bore 30 to the barrel 28.

The slide cover assembly 26 includes a left side wall 50 and right sidewall 52 that engage the chamber housing 18 on each side by a slot 54 formed on each side of the chamber housing 18. Tabs 56*a* and 56*b* are sized to be slightedly receivable within the slot 54. Slot 54 provides a track upon which the slide cover assembly can move forward and aft over the chamber housing 18.

The side walls 52 and 54 are interconnected by a bolt 58 and nut 60. The bolt 58 passes through a cover 62 which is adapted to appear as a false safety switch. Although in the present embodiment the cover 62 appears as a false safety switch, it could have any number of chosen design appearances. The cover 62 nests within a recess formed on the side wall 50 wherein opening 66 engages a post 70 for proper alignment of the cover upon the sidewall 50. The bolt passes through an aperture 72 formed in the side wall 50. The bolt further passes through components of the bolt assembly 22 (described below) to be received through aperture 74 of the sidewall 52, cover 64 and secured by nut 60. Opening 68, in cover 64, engages a post (not shown) in the sidewall 52. Thus, the sidewall 50 and 52 are secured through bolt assembly components 22. Movement of the slide assembly 26 is integral with the bolt assembly 22. Thus, the aft end of the slide cover assembly 26 is secured to the bolt assembly 22, but in the forward end of the slide assembly, the side walls 50 and 52 are secured to the chamber housing 18 by bolts 76 which pass through springs 78. The combination bolt 76 and spring 78 pass through an opening 80 formed within the chamber housing 18, and the springs interconnect with the tabs 56*a* and 56*b*. The spring 78 connection with the chamber housing allows the slide assembly 26 to move freely over the chamber housing 18, but such movement is restricted by the springs 78 which act as a biasing force to pull the slide cover housing to the forward position after re-coil and firing of the pistol.

Figure 2:
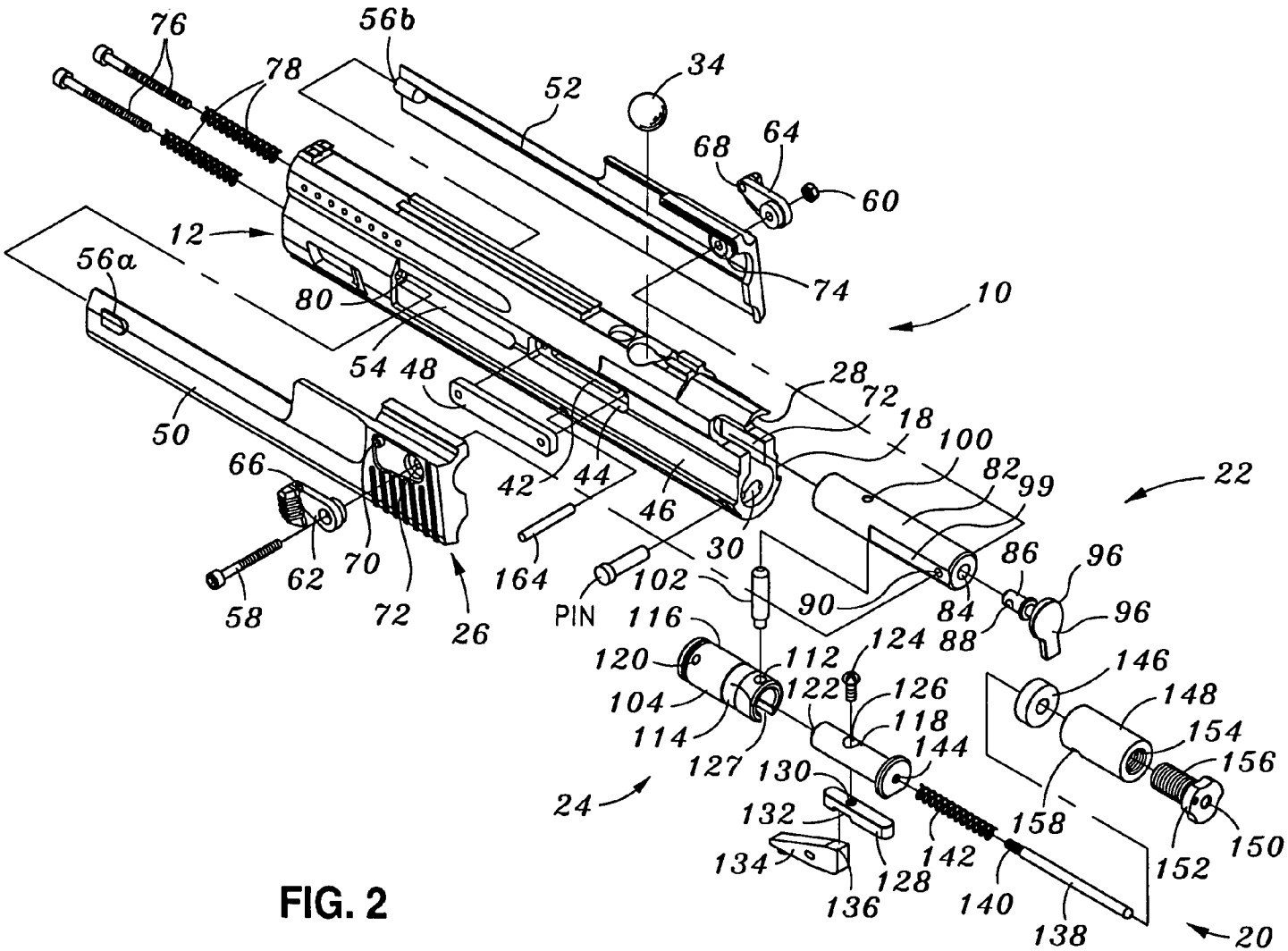
FIG. 2 is an exploded view of the components of the marker pistol body.

Again, referring particularly to FIGS. 1 and 2, and particularly to the bolt assembly 22, such bolt assembly 22 includes a bolt 82, which includes a rear bore 84 for receiving an insert 86. The insert 86 includes an aperture 88 to align with an aperture 90 which passes through the entire width of the bolt 82. When aligned, and inserted within the barrel bore 28 aligns with the apertures of 72 and 74 of sidewalls 50 and 52. Thus, the bolt 58 passes through sidewall 50 into aperture 90, through aperture 88 and through the bolt to interconnect with the aperture 74 of the side wall 52. Thus, less the bolt assembly 82 is integral with the slide cover assembly 26. A notch 92 is provided to accommodate movement of the slide assembly 26 over the chamber housing 18, and to provide clearance of the bolt 58 and the related interconnections. Although the bolt is generally cylindrical, a flattened region 94 is formed onto the sides of the bolt 82 to aid in a flush connection between the sidewalls 50 and 52 and the bolt 82. A rear tab 96 is interconnected with the insert 86 such that when connected to the sidewalls 50 and 52 the tab edge 98 is flush with the edges of the sidewalls 50 and 52.

Figure 6:
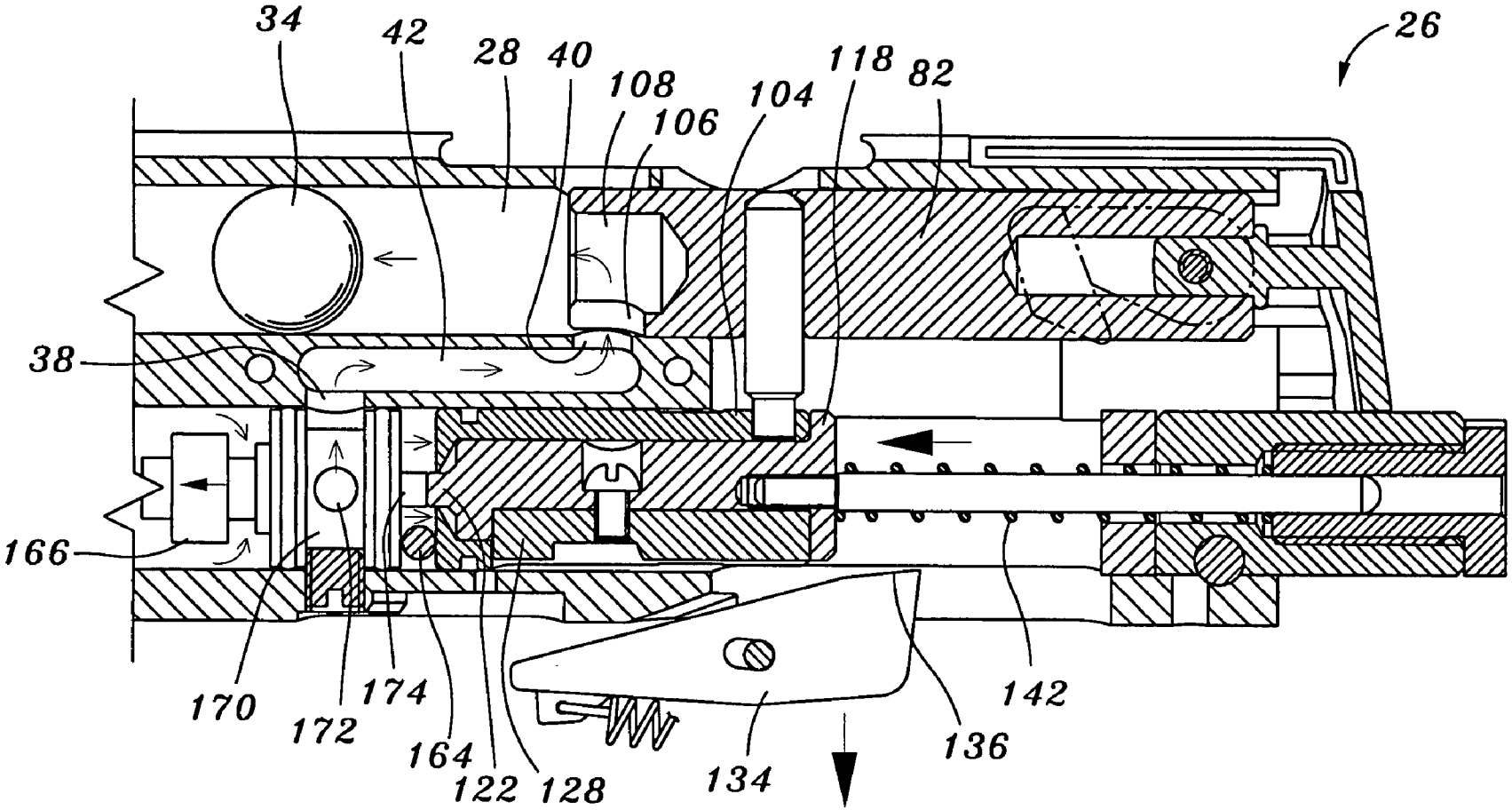
FIG. 6 is a partial cross-sectional side view of the paintball marker pistol showing the internal bolt and hammer assembly in the just fired position, and showing air flow direction.

Aperture 100 is provided to engage in interconnect of post 102. The interconnecting post 102 interconnects the bolt 82 and the bolt assembly 22 to a hammer sleeve 104 of the hammer assembly 24. As best shown in FIG. 1 and FIG. 6, opening 106 provides a continuous air passage from the opening 40 through the front opening 36 to expel gas and the paintball down the barrel of the marker pistol 10. Because the bolt 82 and the hammer sleeve 104 are interconnected via post 102 and the hammer sleeve 104 and bolt 82 move within the chamber housing 18, the connection channel 110 is provided to allow movement of the components within the chamber housing 18.

The hammer assembly 24 includes a hammer sleeve 104 that engages the interconnection post 102 through aperture 112. Thus, the hammer sleeve 104 moves in tandem with the bolt 82. The hammer sleeve 104 includes an annular recess 114.

The sleeve 104 includes a open bore 116 which is sized to receive the compression hammer 118. The sleeve 104 includes a front opening 120 which is sized to allow a protrusion 122 to pass through sleeve 104 to engage a component of the valve assembly (described below). The compression hammer 118 includes a fastener 124 through the aperture 126 to interconnect the hammer 118 to a hammer stop 128 through and aperture 130. The sleeve 104 includes a notch 127 accommodate the hammer stop 128. The notch 127 allows the hammer stop 128 pass, thus allowing hammer 118 to be positioned properly and preventing the hammer 118 from turning out of position within the chamber 30. The hammer stop 128 includes a notch 132 on the underside of the hammer stop 128 which is sized and adapted to receive contact with the sear 134, contact surface 136. A spring positioning bar 138 with a threaded end 140 is inserted through the compression spring 142 and the threads are inserted into aperture 144 of the compression hammer 118. The positioning bar is then inserted through a buffer 146, rear stopper 148 and the aperture 150 of adjustment knob 152. The rear stop 148 includes a bore 154 for receiving the threads 156 of adjustment knob 152. The adjustment knob can increase or decrease the pressure upon compression spring 142. A pin aperture 158 is provided in the rear stop 148 to be aligned with an opening in the chamber housing 18 to receive a pin 160. An open channel 162 provides an opening to allow sear 134 to move within the chamber housing. A hammer stop 164 is inserted into an aperture within the chamber housing 18 to provide the forward most movement of the hammer sleeve 128.

Referring particularly to FIGS. 1 and 6, a poppet valve 166 is shown located within the bore 30, on the opposite side of the hammer stop 164. The poppet valve is secured within the bore 30 by a placement screw 168 which is received within an annular recess 170. An opening 172 provides airflow within the recess 170 when the valve is actuated. The valve is actuated by a compression switch 174. When compressed, the compression switch 174 allows a burst of gas to escape towards the hammer sleeve 128 and up through the opening 38, chamber 42, and upper opening 40 to provide high gas pressure to the barrel 28, to expel the paintball 34. The poppet valve 166 is actuated when the compression hammer 118 is inserted within the hammer sleeve 104 to allow the passage of the protrusion 122 to strike the compression switch 174.

Figure 3:
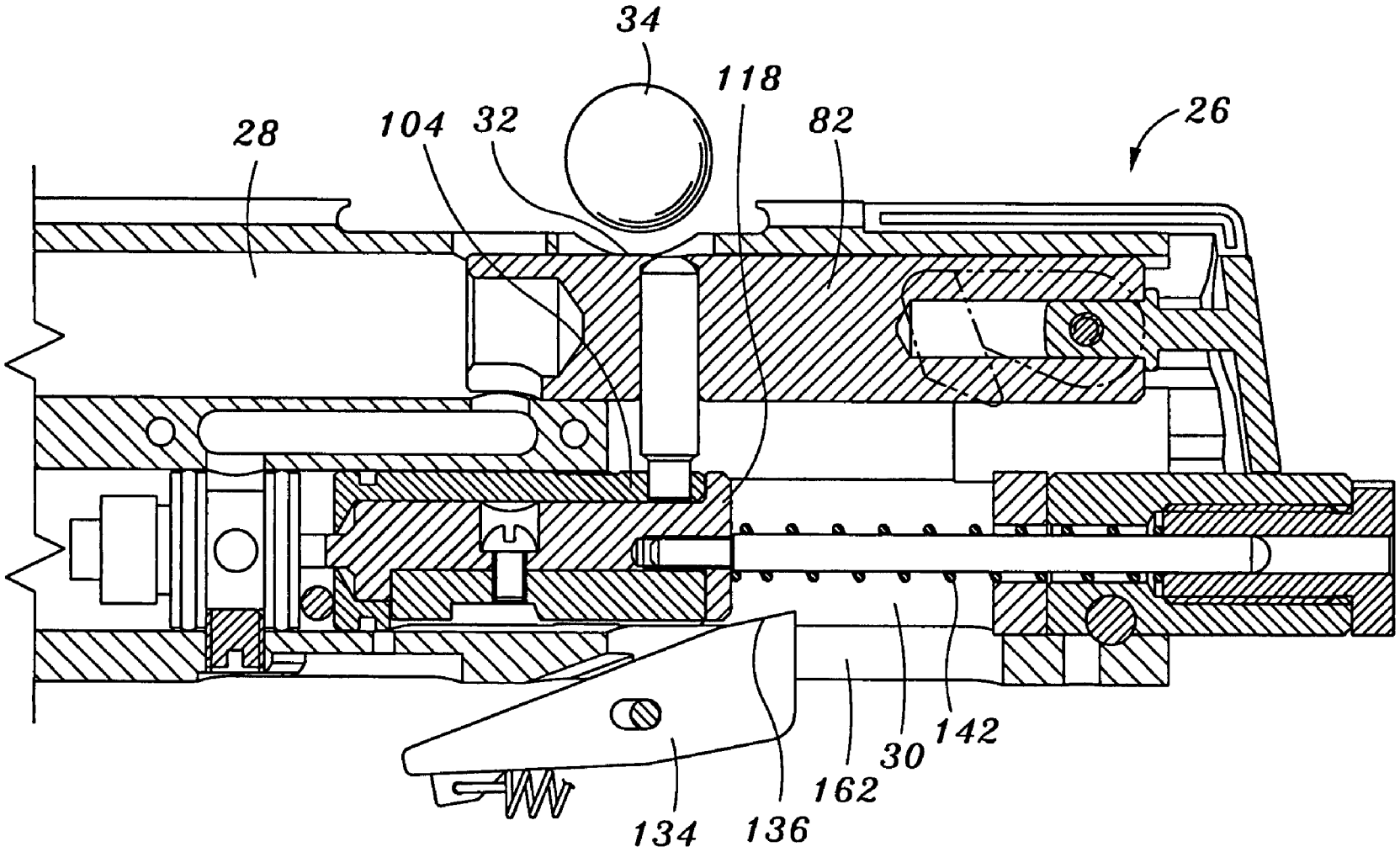
FIG. 3 is a partial cross-sectional side view of the paintball marker pistol body to showing the internal bolt and hammer assembly in the safety position.

Referring particularly to FIG. 3, there is shown a partial cross-sectional side view of the paintball marker pistol body showing the internal bolt and hammer in the safety position. More particularly, in the safety position, the bore 82 sets forward in the barrel bore 28, thus closing the breach 32 so that a paintball 34 cannot pass into the bore 28. The sear 134 is positioned so that the contact surface 136 is raised up within the open channel 162 into the lower chamber 30. In this position, the spring 142 is not compressed. The compression hammer 118 is forward nested within the hammer sleeve 104. The slide assembly 26 is in a forward position.

Figure 4:
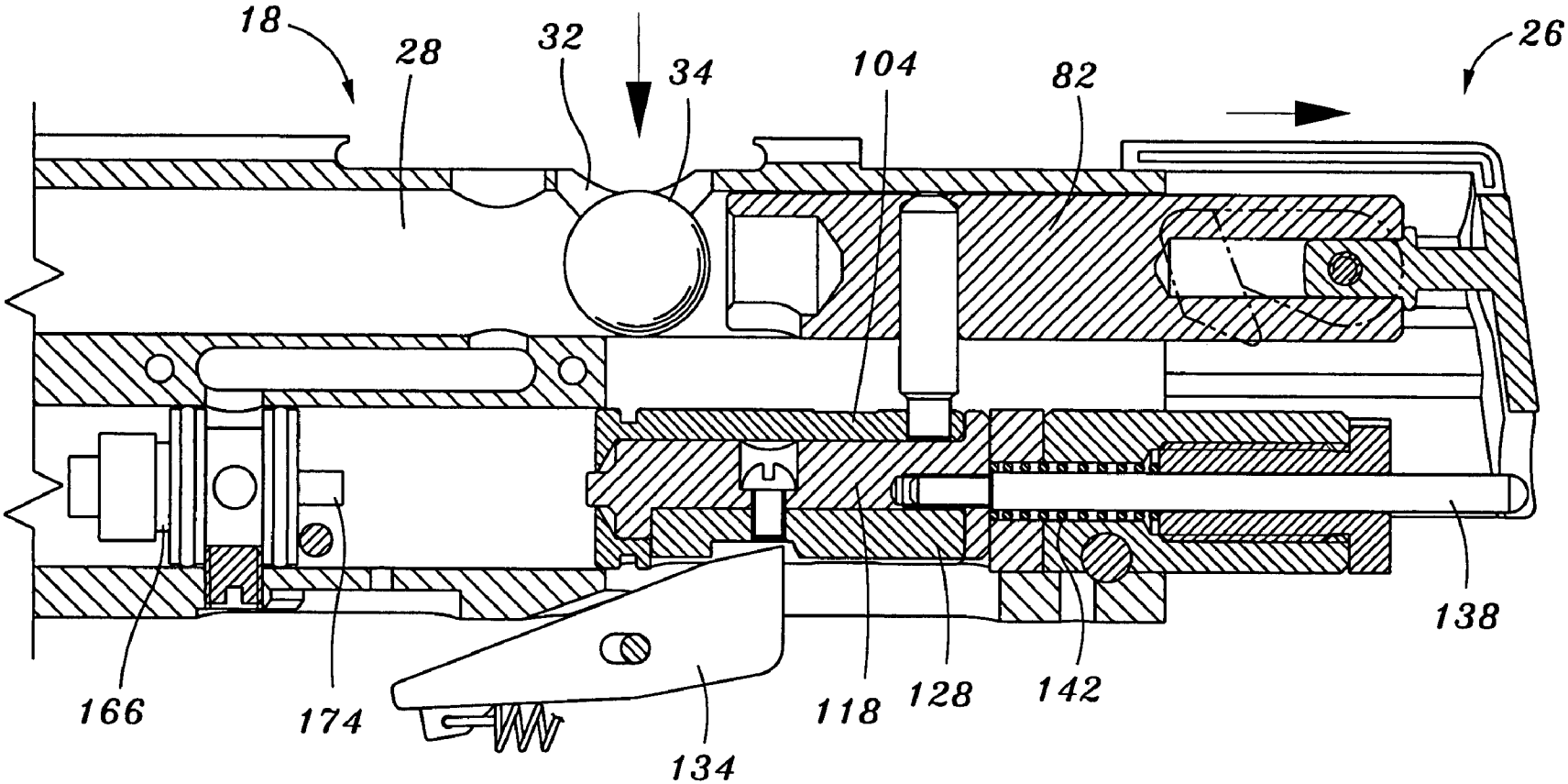
FIG. 4 is a partial cross-sectional side view of the paintball marker pistol body showing the internal bolt and hammer assembly in the loading and mid-cocking position.

Referring particularly to FIG. 4 there shown a partial cross-sectional side view of the paintball marker pistol body showing the internal bolt and hammer assembly in the loading and mid-cocking position. To cock, the slide assembly 26 is moved rearward, and because it is interconnected to the bolt 82. The bolt 82 moves backwards to clear the breach 32 and to allow a paintball 34 to drop within the barrel 28 of the chamber housing 18. Because the bolt 82 and the hammer sleeve 104 are interconnected, the movement backwards of the bolt 82 additionally causes a backward movement of the hammer sleeve 104. Because the compression hammer 118 is nested within the hammer sleeve 104 it additionally moves rearward forcing the rod 138 rearward and compressing spring 142. The sear 134 locks the compression hammer 118 by the hammer stop 128. The compression switch 174 of the valve 166 is in an extended ready position.

Figure 5:
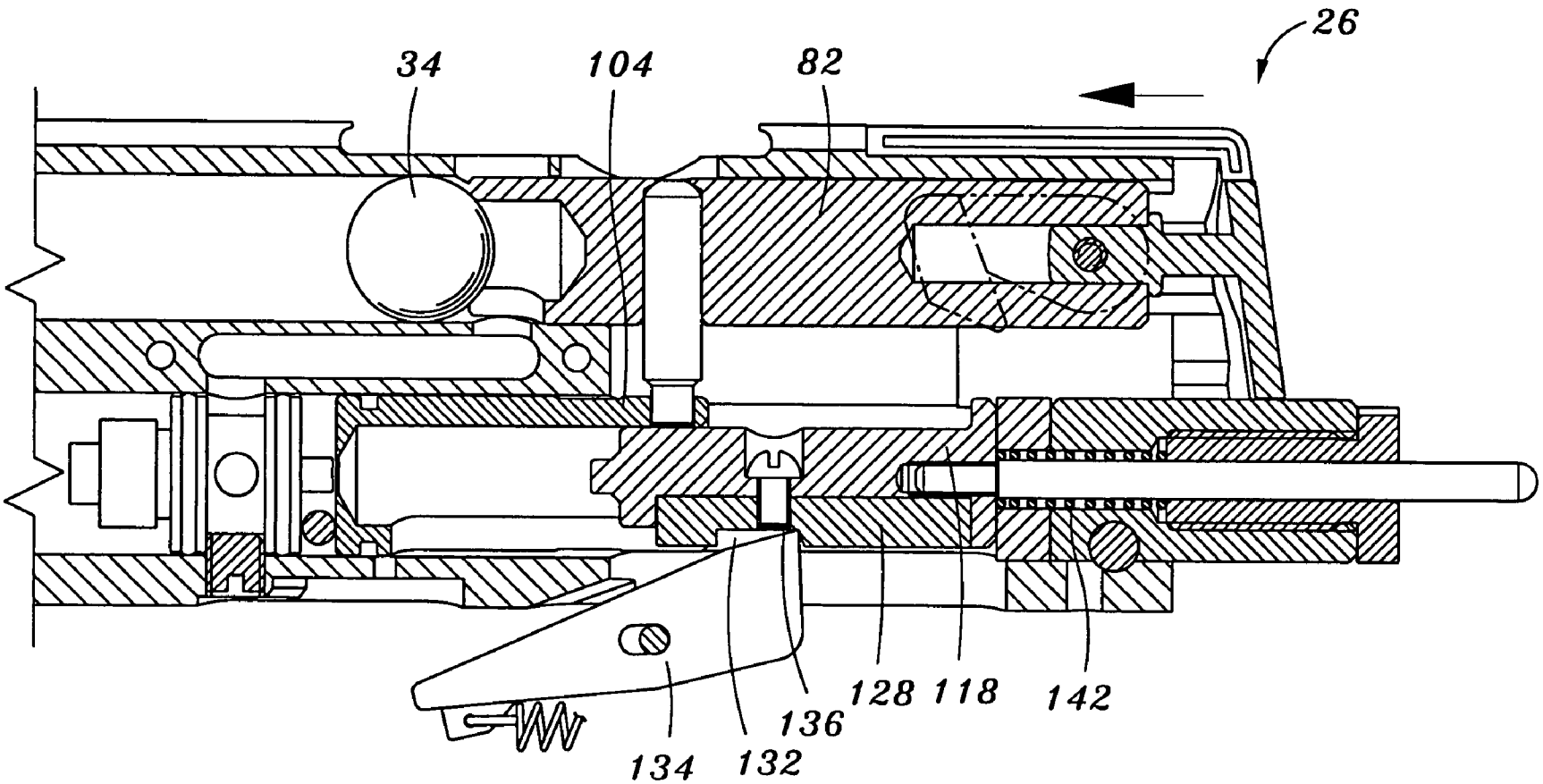
FIG. 5 is a partial cross-sectional side view of the paintball marker pistol body showing the internal bolt and hammer assembly in fully cocked and ready to fire position.

Referring particularly to FIG. 5, showing the partial side cross-sectional view of the paintball marker pistol body showing the internal bolt and hammer assembly in the fully cocked and ready to fire position. The slide assembly 26 moves slightly forward so that the bolt 82 buts the paintball 34 to place in a slightly more favorable position than is shown in FIG. 4. The sear 134 is fully locked into place in the slot 132 of the hammer block 128. Because the bolt 182 has moved forward, which is caused by the springs 78 (not shown) interconnected between the housing chamber 18, the slide assembly 26 moves the bolt 82 forward. Since the bolt 82 is interconnected to the hammer sleeve 104, the hammer sleeve is additionally moved forward to a ready to fire position. Thus, the hammer 118 is positioned to be released by movement of the sear 134 and propelled forward by the compressed spring 142.

Referring particularly to FIG. 6 there showed a partial cross-sectional side view of the paintball marker pistol body showing the internal bolt and hammer assembly in the just fired position, and also showing gas flow direction. More particularly, the sear 34 is moved by actuation of a trigger 16 (not shown) releasing the hammer block 128. This allows the spring 142 to propel the compression hammer 118 forward to nest within the hammer sleeve 104. The protrusion 122 on the front of the compression hammer 118 strikes the compression switch 174 of the valve 166. This releases a burst of gas from a carbon dioxide cartridge (not shown) and as such, gas is released in two directions. Gas is released from the aperture 172 such that air is forced up through the opening 38, the open channel 42 and through the upper opening 40. Because the bolt 32 has a lower opening 106, gas can be allowed to be forced through the opening 108 into the barrel chamber 28. The gas released into the barrel chamber 28 forces the paintball 34 down the barrel 28 to be propelled from the gun. Gas is also pushed rearward upon the face of the hammer sleeve 104. The force of the gas on the hammer sleeve 104 propels the hammer sleeve rearward in a manner shown in FIG. 4.

Figure 7:
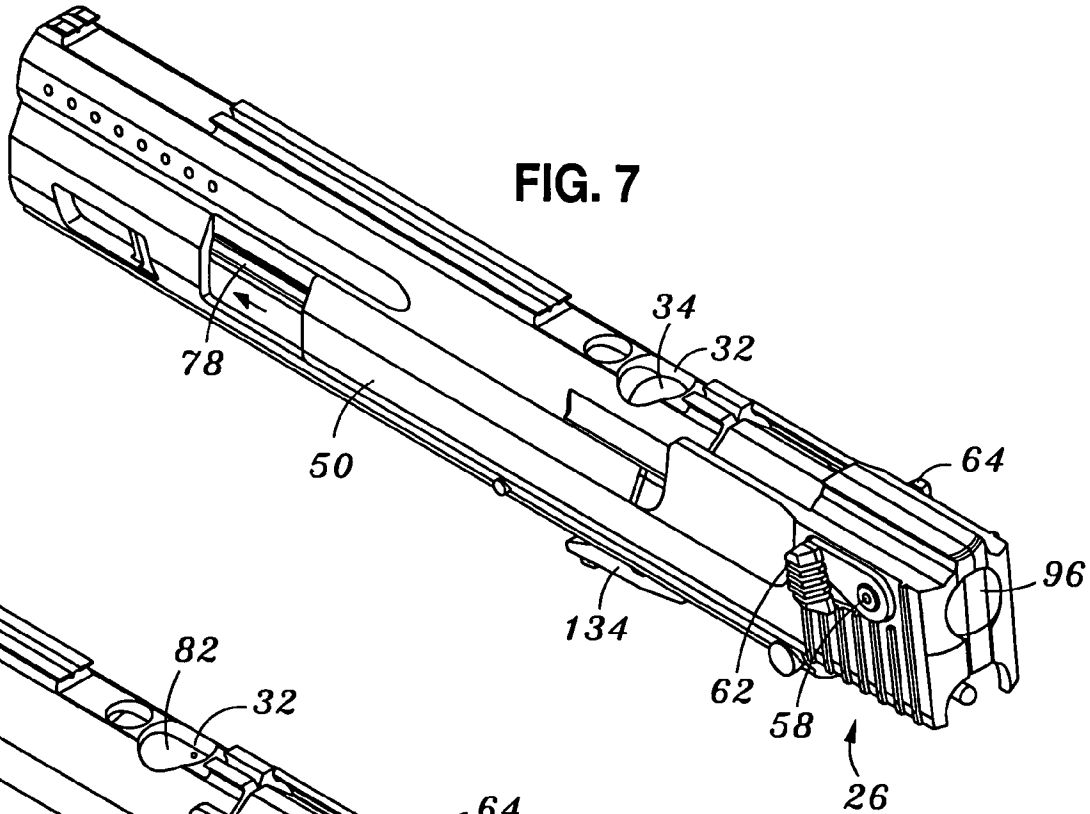
FIG. 7 is a perspective view of the marker pistol body showing the slide cover in the just fired, aft position.
Figure 8:
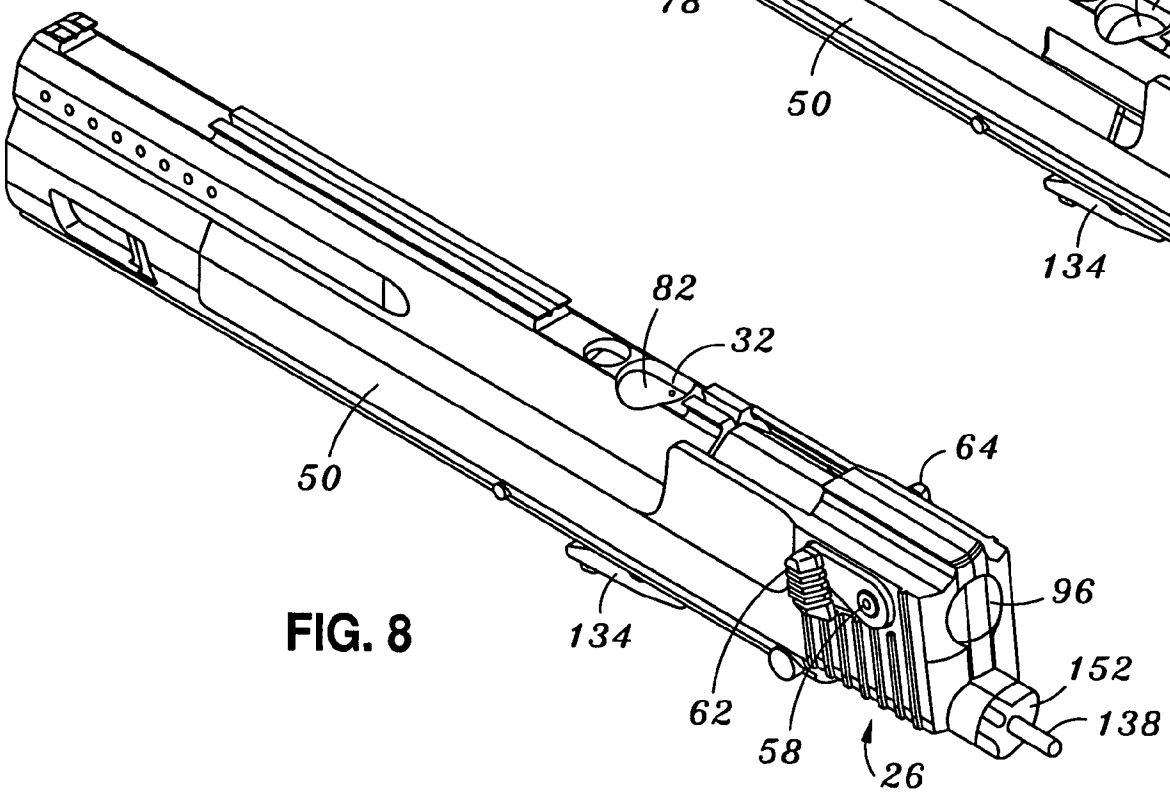
FIG. 8 is a perspective view of the marker pistol body showing the slide cover in the cocked, ready to fire forward position.

Referring particularly to FIGS. 7 and 8, there are shown perspective views of the marker pistol body, showing the slide cover in the just fired aft position of FIG. 7 and the cocked and ready to fire forward position as shown in FIG. 8. The just fired position of FIG. 7 (with the internal structure shown in FIG. 4) the breach 34 opens to allow a paintball 34 to drop into the gun for firing. The springs 78 provide a biasing action to the front of the gun to pull the assembly 26 toward the front of the gun, so that is reaches the closed position as shown in FIG. 8. In the closed position, the forward action of the slide assembly 26, because it is attached to the bolt 82, pulls the bolt forward to close the breach 32 and place the paintball into position for firing.

The forward action of the spring 78 upon the slide assembly 26 eliminates the need for a secondary system to close the bolt as required in conventional closed bolt assemblies. Thus, the marker pistol 10 of the present invention allows the use of an open bolt design to create the satisfactory closed bolt results without having the additional expense and bulkiness of a secondary system to close the bolt 82.

Referring to FIGS. 3, 4, 5, 6, 7, and 8 collectively, in operation, upon compression of the trigger 16 (not shown) movement of the sear 134 and release of the compression hammer 118, through the bore 116 of the sleeve 104, allows the protrusion 122 of the compression hammer 118 to extend through the front wall aperture 120 of the sleeve 104 and to strike the compression switch 174 of the poppet valve 166. As a result, the poppet valve of 166 releases a burst of gas pressure into the lower bore 30 and the barrel 28 of the chamber housing 118 through the air passage defined by opening 38, open channel 42, and upper opening 40. The gas pressure forced into the bore 28 causes the paintball 34 to be expelled from the barrel 28. The hammer and bolt assembly which comprises the hammer sleeve 104 and the compression hammer 118 to be forced backwards in the lower bore 30 by the increase in pressure. The pressure against the front wall and hammer sleeve 104 pushes the hammer sleeve 104 aft along with the compression hammer 118 now nested in the sleeve bore 116. The bolt 82, interconnected to the hammer sleeve 104 by the post 100 is also forced back in the upper barrel 28. When forced back, the bolt 82 allows the breach 32 to open and a paintball 34 to drop into the barrel 28. The sear 134 catches the compression hammer 118 by the hammer block 128 in the cocked position and the interconnected combination of the hammer sleeve 104, bolt 82 and slide cover 26 causes the slide cover 26 to move back as well simulating the re-coil sliding action of a conventional firearm. The spring 78 interconnected between the slide cover 26 and the chamber housing 18 biases the slide cover 26 to return to its former position. Because the slide cover 26 is interconnected to the bolt 82 and the hammer sleeve 104, the return of the slide cover 26 forward by the spring 78 also resets the bolt 82 and hammer sleeve 104 to their forward ready to fire position. The forward position of the bolt 82 closes the breach 32 of the barrel 28 to exclude other paintballs from dropping into the barrel 28.

Figure 9:
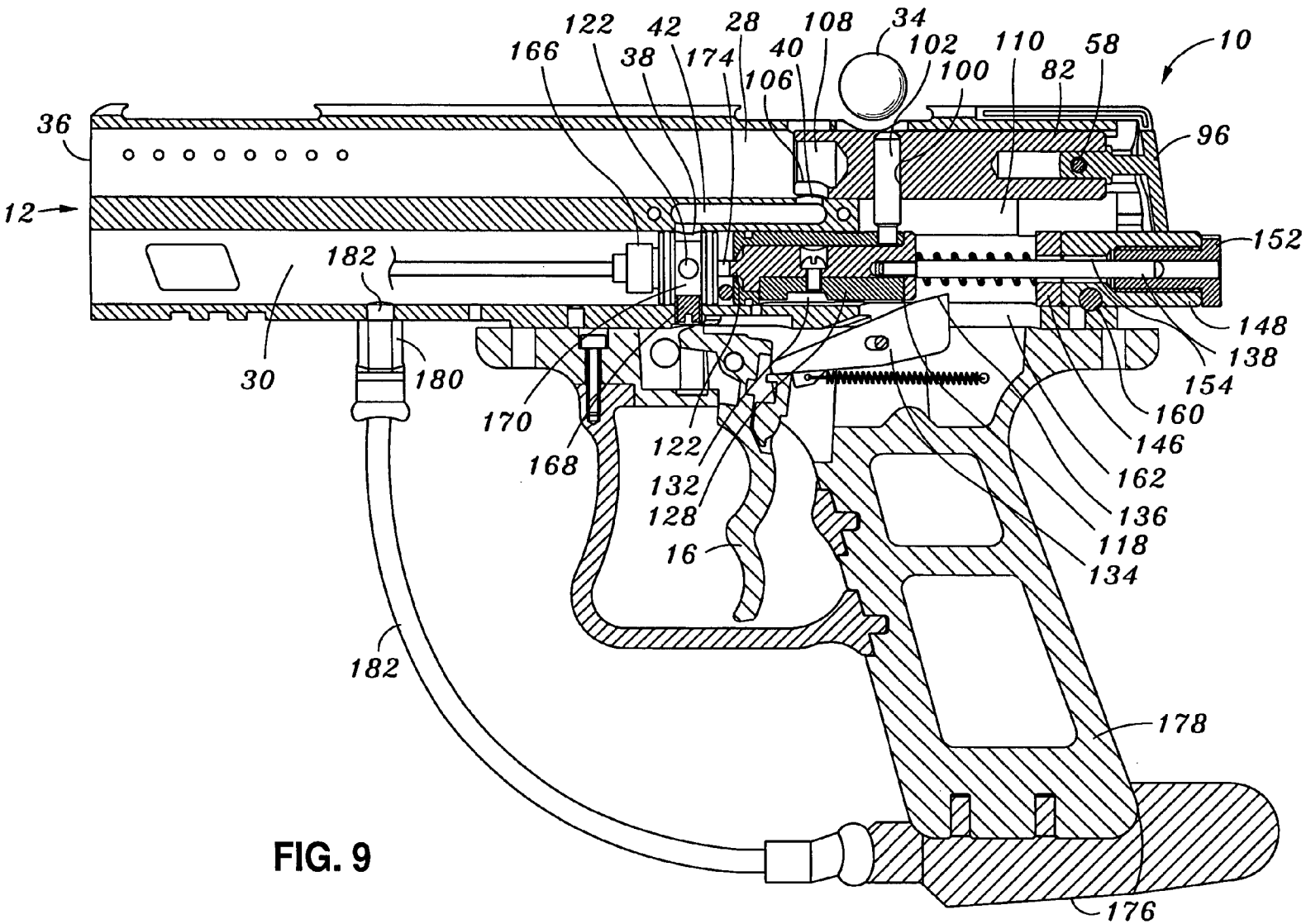
FIG. 9 is cross-sectional a side view of the paintball marker pistol of the present invention further including a secondary gas pressure canister.

Referring in particularly to FIG. 9, there is shown the paintball marker 10 of the present invention with an additional secondary gas source, particularly, a gas canister 176 is connected to the handle 178 of the handle assembly. A connection bolt 180 interfaces with an aperture 182 located on the underside of the housing 18. The gas canister 176 is interconnected to the valve 166 by a lumen 182. A further lumen, internal to the chamber (not shown) supplies gas to the poppet valve 166. It is understood and appreciated that the canister although shown interconnected to the handle assembly may be positioned elsewhere on the marker pistol 10.

It should be noted and understood that with respect to the embodiments of the present invention, the materials suggested may be modified or substituted to achieve the general overall resultant high efficiency. The substitution of materials or dimensions remains within the spirit and scope of the present invention.

What is claimed is:

1. A paintball marker gun comprising;

a handle assembly;

a gun body assembly interconnected to said handle assembly, said gun body comprising;

a) a parallel chamber housing having a forward end and an aft end, said housing comprising;

i) an elongate barrel for receiving and expelling paintballs, said barrel having a forward end and an aft end; and ii) an elongate bore having a forward end and an aft end wherein said barrel and bore are in gas flow communication;

b) a slide cover, adapted to partially cover and slideably engage the chamber housing between forward and aft positions; and c) a biasing member interconnected between said chamber housing and said slide cover to provide a biasing force upon said slide cover to bias the slide cover to the forward position;

a gas pressure source;

a poppet valve positioned within the bore of the chamber housing in gas flow communication with the gas pressure source, said poppet valve having a compression switch for opening the valve and releasing high pressure gas into the bore and barrel of the chamber housing;

a hammer and bolt assembly positioned within the chamber housing, said hammer and bolt assembly comprising;

a) a generally cylindrical bolt positioned in the barrel of said chamber housing, said bolt interconnected to said slide cover, said bolt moveable between a forward and aft position;

b) a hammer assembly positioned in the bore of said chamber housing, said hammer assembly comprising;

i) a compression hammer movable between forward and aft positions, wherein in said forward position said compression hammer engages the compression switch of the poppet valve, and wherein said aft position, said hammer assembly is cocked;

ii) a biasing member in mechanical communication with said compression hammer to provide a biasing force upon said compression hammer to bias the compression hammer to the forward position; and iii) a generally cylindrical hammer sleeve having a forward aperture and aft aperture, said hammer sleeve movable between forward and aft positions and interconnected to said bolt, said hammer sleeve having an internal bore sized to receive the compression hammer through said aft aperture, and said front aperture sized to permit passage of at least a portion of the compression hammer in its forward position to engage the compression switch of the poppet valve; and an actuator in mechanical communication with said compression hammer, for releaseably holding the compression hammer in a cocked configuration.

2. The paintball marker gun of claim 1 wherein said barrel has a breach for receiving a paintball.

3. The paintball marker gun of claim 1 further comprising a paintball clip interconnected to said gun body for feeding paintballs into said barrel.

4. The paintball marker gun of claim 1 further comprising a velocity adjustor in mechanical communication with said poppet valve for regulating the amount of gas expelled from the gas source upon actuation of the compression switch.

5. The paintball marker gun of claim 1 further comprising a tension adjustment in mechanical communication with said bore biasing member.

6. The paintball marker gun of claim 1 further comprising a manual trigger in mechanical communication with said actuator.

7. The paintball marker gun of claim 1 further comprising a manual trigger in mechanical communication with said actuator, said trigger interconnected to said handle assembly.

8. A paintball marker gun comprising;

a gun body assembly comprising;

a) a chamber housing having upper and lower parallel bores in gas flow communication, said upper bore having an open front end for expelling paintballs;

b) a slide cover, adapted to partially cover and slideably engage the chamber housing between forward and aft positions; and c) a biasing member interconnected between said chamber housing and said slide cover to provide a biasing force upon said slide cover to bias the slide cover to the forward position;

a poppet valve positioned within the lower bore of the chamber housing in gas flow communication with a gas pressure source, said poppet valve having a compression switch for releasing high pressure gas into the upper and lower bores of the chamber housing;

a hammer and bolt assembly positioned within the chamber housing, said hammer and bolt assembly comprising;

a) a generally cylindrical bolt positioned in the upper bore of said chamber housing, said bolt interconnected to said slide cover, said bolt moveable between a forward and aft position within the bore;

b) a hammer assembly positioned in the lower bore of said chamber housing, said hammer assembly comprising;

i) a compression hammer movable between forward and aft positions within said lower bore, wherein in said forward position said compression hammer engages the compression switch of the poppet valve, and wherein said aft position, said hammer assembly is cocked;

ii) a biasing member in mechanical communication with said compression hammer to provide a biasing force upon said compression hammer to bias the compression hammer to the forward position; and iii) a generally cylindrical hammer sleeve having a forward aperture and aft aperture, said hammer sleeve movable between forward and aft positions and interconnected to said bolt, said hammer sleeve having an internal bore sized to receive the compression hammer through said aft aperture, and said front aperture sized to permit passage of at least a portion of the compression hammer in its forward position to engage the compression switch of the poppet valve; and an actuator in mechanical communication with said compression hammer, for releaseably holding the compression hammer in a cocked configuration.

9. The paintball marker gun of claim 8 wherein said upper bore has a breach for receiving a paintball.

10. The paintball marker gun of claim 8 further comprising a paintball clip interconnected to said gun body for feeding paintballs into said upper bore.

11. The paintball marker gun of claim 8 further comprising a velocity adjustor in mechanical communication with said poppet valve for regulating the amount of gas expelled from the gas source upon actuation of the compression switch.

12. The paintball marker gun of claim 8 further comprising a tension adjustment in mechanical communication with said lower bore biasing member.

13. The paintball marker gun of claim 8 further comprising a manual trigger in mechanical communication with said actuator.

14. The paintball mark of claim 8 further comprising a handle assembly interconnected to said gun body.

15. The paintball marker gun of claim 8 further comprising a manual trigger in mechanical communication with said actuator wherein said trigger is interconnected to a handle assembly interconnected to the gun body.

* * * * *